United States Patent [19]

Fukuroi

[11] Patent Number: 4,571,780

[45] Date of Patent: Feb. 25, 1986

[54] BUTTON HAVING ATTACHMENT TACK DEFORMED BY ANVIL

[75] Inventor: Takeo Fukuroi, Uozu, Japan

[73] Assignee: Nippon Notion Kogyo Co., Ltd., Tokyo, Japan

[21] Appl. No.: 600,019

[22] Filed: Apr. 13, 1984

[30] Foreign Application Priority Data

Apr. 13, 1983 [JP] Japan ..... 58-55047[U]
Dec. 29, 1983 [JP] Japan ..... 58-199963[U]

[51] Int. Cl.[4] ..... A44B 1/42

[52] U.S. Cl. ..... 24/95; 24/90 R; 24/90 C; 24/94; 24/689

[58] Field of Search ..... 24/90 R, 90 C, 94, 95, 24/96, 101 B, 113 R, 113 MP, 687, 689, 671, 674

[56] References Cited

U.S. PATENT DOCUMENTS

| | | | |
|---|---|---|---|
| 222,309 | 12/1879 | Robertson | 24/95 |
| 268,021 | 11/1882 | Howard | 24/95 |
| 329,337 | 10/1885 | Platt | 24/94 |
| 1,191,944 | 7/1916 | Carley | 24/95 |
| 1,646,053 | 10/1927 | Clark | 24/95 |
| 1,707,592 | 4/1929 | Abel | 24/95 |
| 1,718,843 | 6/1929 | White et al. | 24/95 |
| 2,018,104 | 10/1935 | White | 24/95 |
| 2,108,255 | 2/1938 | Devendor et al. | 24/95 |
| 2,254,418 | 9/1941 | Carley | 24/95 |
| 3,320,644 | 5/1967 | Daddona, Jr. | 24/95 |

FOREIGN PATENT DOCUMENTS

| | | |
|---|---|---|
| 126542 | 5/1937 | Japan . |
| 445791 | 3/1969 | Japan . |

*Primary Examiner*—Victor N. Sakran
*Attorney, Agent, or Firm*—Hill, Van Santen, Steadman & Simpson

[57] ABSTRACT

A tack member, which is adapted to be joined with a button body for attachment of a button to a garment fabric, has a shank composed of a tapering end portion and a stem portion. The shank has a cold-pressed recess near the tapering end portion. The tapering end portion is in the shape of a pyramid with its tip end disposed off the axis of the shank toward the recess so that the tapering end portion is bendable about the recess as its tip end is forced against the inner side of a cap of the button body during insertion of the shank into a hollow hub of the button body, during which time the stem portion opposes bending or other deformation.

6 Claims, 13 Drawing Figures

BUTTON HAVING ATTACHMENT TACK DEFORMED BY ANVIL

BACKGROUND OF THE INVENTION

1. Field of the Invention

The present invention relates to a button including a button body and a tack member adapted to be joined with the button body for attachment of the button to a garment.

2. Prior Art

A known button comprises a button body and a tack member adapted to be joined with the button body for attachment of the button to a garment fabric. In attachment, a shank of the tack member is pierced through a garment fabric and is then forced through a hollow hub of the button body so as to deform or bend a tapering end of the shank, thus securing the latter to the hollow hub of the button body. However, in this prior button the tapering end portion of the tack member's shank is usually in the shape of a pyramid with its tip end disposed on the axis of the shank and hence requires relatively great force for the bending of the tapering end portion. This great force often causes not only the tack member's shank but also the button body's hollow hub to be objectionably deformed or otherwise damaged. Further, since the tip end of the pyramid-shaped end portion is disposed on the axis of the shank, the tip end would tend to penetrate into the back plate. As a consequence, accurate and firm joining of the tack member with the button body cannot be achieved.

Japanese Utility model Publication (Kokoku) 44-5791 discloses a tack member in which a shank has a lateral groove of square cross section near its tapering end portion so that the tapering end portion is bendable about the recess as the shank is inserted into a hollow hub of a button body. Another attempt has been made, as disclosed by Japanese Utility Model Publication (Kokoku) 12-6542, in which a shank has a plurality of lateral grooves of V-shaped cross section near its tapering end portion to facilitate bending. However, the groove or grooves of either Japanese Publication are formed by cutting, which makes the shank mechanically weak around such cutouts. With this structural weakness of the shank the tack member would tend to be easily deformed or bent back so as to be removed from the button body when a relatively great pulling force is exerted on the button.

SUMMARY OF THE INVENTION

In a button according to the present invention, a tack member, which is adapted to be joined with a button body for attachment of the button to a garment fabric, has a shank composed of a tapering end portion and a stem portion. The shank has a cold-pressed recess near the tapering end portion. The tapering end portion is in the shape of a pyramid with its tip end disposed off the axis of the shank toward the recess so that the tapering end portion is bendable about the recess as its tip end is forced against the inner side of a cap of the button body during insertion of the shank into a hollow hub of the button body, during which time the stem portion opposes bending or other deformation.

It is therefore an object of the invention to provide a button in which a tack member's shank can be secured to a button body's hollow hub easily and accurately not only without dampage of the button body's hollow hub or any other part, but also without any likelihood of subsequent accidental removal of the tack member from the button body.

Many other advantages, features and additional objects of the present invention will become manifest to those versed in the art upon making reference to the detailed description and the accompanying drawings in which preferred embodiments incorporating the principles of the present invention are shown by way of illustrative example.

DETAILED DESCRIPTION

Figure 1:
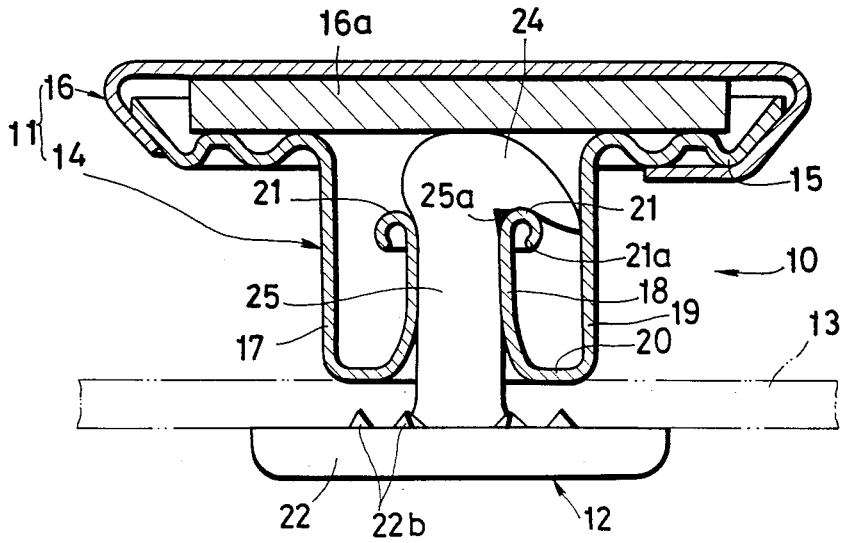
FIG. 1 is a front elevational view, partly in cross section, of a button embodying the present invention, showing the button having been attached to a garment fabric.

The principles of the present invention are particularly useful when embodied in a button as shown in FIG. 1, generally indicated by a numeral 10.

The button 10 comprises a button body 11 and a tack member 12 (joined with the button body 11 in a manner described below), attaching the button 10 to a garment fabric 13. Both the button body 11 and the tack member 12 are made of metal, preferably brass.

Figure 2:
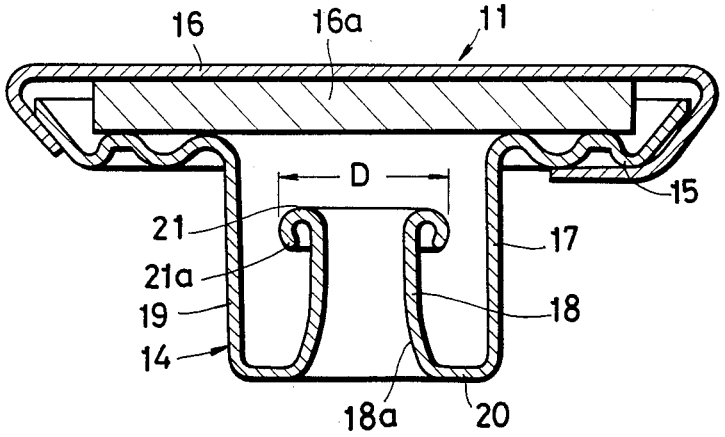
FIG. 2 is a vertical cross-sectional view of a button body.

As shown in FIGS. 1 and 2, the button body 11 includes a button back 14 having an annular rim 15 covered by a cap 16. A circular back plate **16*a* is sandwiched between the button back 14 and the cap 16, for a purpose described below. Alternatively, the back plate 16*a* may be an integral part of the cap 16. The button back 14 also has a hollow hub 17 in the form of a double tube of circular cross section projecting downwardly from an inner edge of the annular rim 15. The double-tube hub 17 is composed of a pair of concentric inner and outer tubes 18, 19 joined at their lower ends by an annular turn or portion 20. The inner tube 18 has a curled annular flange 21 projecting outwardly from an upper end of the inner tube 18 and terminating in an edge 21*a* which defines a circle of a diameter smaller than the maximum outside diameter D (FIG. 2) of said curled annular flange 21**.

Figure 3:
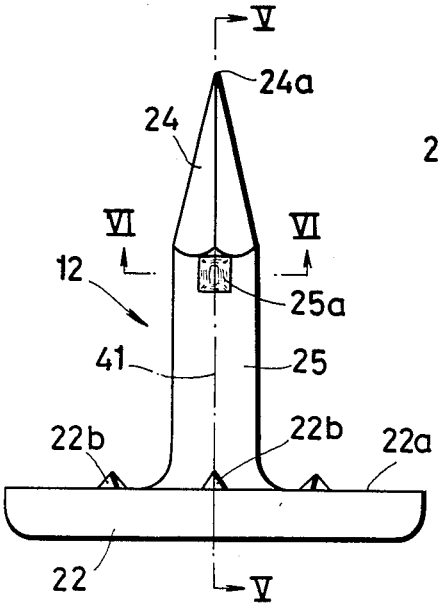
FIG. 3 is a side elevational view of a tack member, showing the same before having been joined with the button body.
Figure 4:
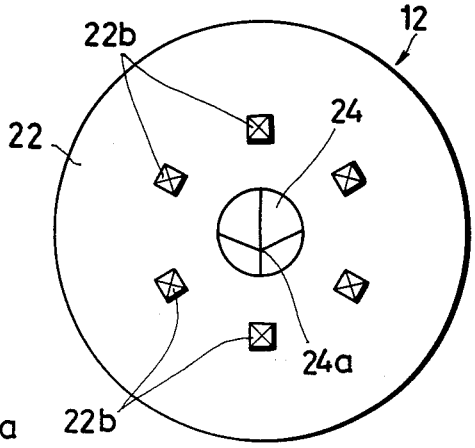
FIG. 4 is a plan view of the tack member of FIG. 3.
Figure 5:
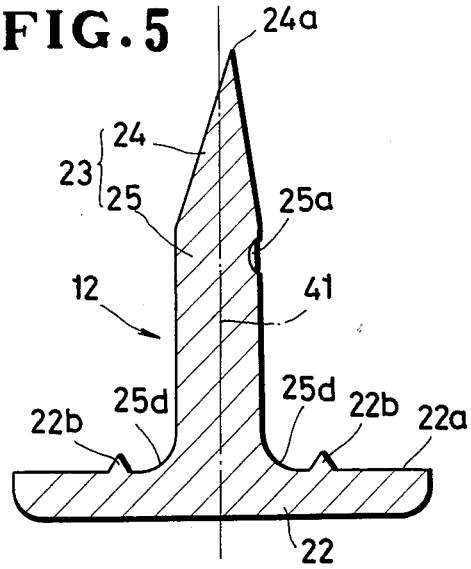
FIG. 5 is a vertical cross-sectional view taken along line V—V of FIG. 3.

FIGS. 3 to 5 illustrate the tack member 12 before its having been joined with the button body 11 as shown in FIG. 1. The tack member 12 includes a disk-like head 22 and a shank 23 projecting perpendicularly and centrally from one face 22*a* of the head 22 for piercing through the garment fabric 13 (FIG. 1) and also for being inserted through the hollow hub 17 of the button back 14. The head 22 is substantially flat on opposite faces, one of which has a plurality of angularly spaced teeth 22*b* arranged in a circle around the shank 23.

Figure 6:
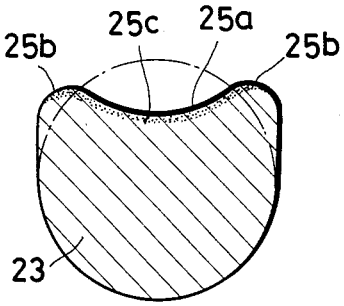
FIG. 6 is an enlarged cross-sectional view taken along line VI—VI of FIG. 3, showing a recess in the tack member's shank.
Figure 7:
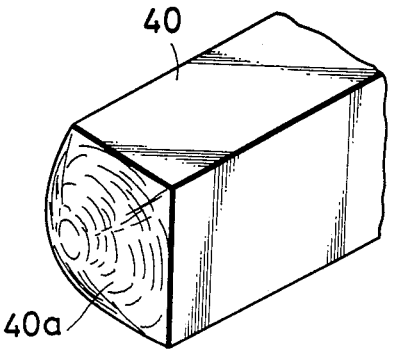
FIG. 7 is a perspective view of a punch used to form the recess of FIG. 6.

The shank 23 is composed of a tapering end portion 24 disposed remotely from the head 22, and a stem portion 25 of circular cross section extending between the head 22 and the tapering end portion 24. At its base, the stem portion 25 has an arcuately curved surface 25*d* (FIG. 5) blending into the flat face 22*a* of the head 22. The shank 23 has a recess 25*a* immediately below or adjacent to the border between the tapering end portion 24 and the stem portion 25. The recess 25*a* is formed by cold pressing, that is, punching a circumferential surface of the shank 23 with a punch 40 (FIG. 7). The punch 40 has a punching end 40*a* in the shape of generally a frustrum of a square pyramid with rounded corners; as a consequence, the recess 25*a* has a contour corresponding to the shape of the punching end 40*a* of the punch 40. As shown in FIG. 6, as the recess 25*a* is thus formed in the shank 23, a mass of material of the shank 23 flows due to plastic deformation, providing a pair of lateral protuberances 25*b*, 25*b* on the opposite sides of the recess 25*a*. Because of this cold pressing, both the walls of the recess 25*a* and the lateral protuberances 25*b* have a surface layer 25*c* (indicated by dots, in FIG. 6, for convenience) harder than the remaining regions of the shank 23.

As shown in FIGS. 3 to 5, the tapering end portion 24 of the shank 23 has a pyramidal configuration defined by four sloping flat surfaces with ridges therebetween meeting at a distal end 24*a*, the number of the sloping surfaces being not pertinent here. The distal end 24*a* of the tapering end portion 24 is disposed off the center axis 41 of the shank 23 toward the recess 25*a*, as shown in FIG. 5.

The position of the recess 25*a* on the shank 23 is such that it is disposed adjacent to the upper end, i.e. the annular flange 21, of the button back's inner tube 18 when the shank 23 is fully inserted through the hollow hub 17 of the button back 14 with the garment fabric 13 sandwiched between the hollow tube 17 and the tack member's head 22.

To attach the button 10 to the garment fabric 13, the shank 23 of the tack member 12 of FIGS. 3 to 5 is caused to pierce through the garment fabric 13 and is then inserted through the inner tube 18 of the button back's hollow hub 17. At that time, the flaring lower end 18*a* of the inner tube 18 allows the shank to be easily inserted into the inner tube 18. With continued insertion of the shank 23, the tapering end portion 24 is bent through an angle of substantially 90 degrees about the recess 25*a* as its distal end 24*a* is forced against the back plate 16*a* sandwiched between the button back 14 and the cap 16. As a result, the tapering end portion 24 lies over and against the curled annular flange 21 of the hollow hub's inner tube 18 to permanently join the shank 23 of the tack member 12 with the inner tube 18 of the button back's hollow hub 17.

Partly because the shank 23 of the tack member 12 has a recess 25*a* immediately below or adjacent to the border between the tapering end portion 24 and the stem portion 25, and partly because the distal end 24*a* of the tapering end portion 24 is disposed off the axis 41 of the shank 23 toward the recess 25*a*, the tapering end portion 24 of the shank 23 can be deformed with only relatively small force, making not only the shank 23 but also the button back's hollow hub 17 free from objectionable bending and inclination. Having at its base the arcuately curved surface 25*d* blending into the flat face 22*a* of the tack member's head 22, the stem portion 25 opposes bending and hence prevents inclination of the shank 23 during insertion of the latter through the button back's hollow hub 17.

With such structure, the shank 23 of the tack member 12 can be secured to the hollow hub 17 of the button back 14 easily and accurately, not only without inclination of either the tack member's shank 23 or the button back's hollow hub 17, but also without bending or otherwise deforming of the shank's stem portion 25. Further, since the recess 25*a* and the lateral protuberances 25*b* (FIG. 6) are formed by cold pressing, the tapering end portion 24 bent over and against the curled annular flange 21 is resistant to bending back toward its original position, thus preventing not only accidental removal of the tack member 12 from the button body 11, but also angular displacement or rotation of the tack member 12 with respect to the button body 11.

As the tack member 12 and the button body 11 are joined together with the garment fabric 13 sandwiched therebetween, the teeth 22*b* of the tack member's head 22 bit into the garment fabric 13, preventing the tack member 12 and thus the whole button 10 from being angularly displaced or rotated with respect to the garment fabric 13.

The curled annular flange 21 serves to distribute a radially outwardly pressing force, exerted on a flange 21, in various directions, thus making the upper end portion of the inner tube 18 free from being easily broken or otherwise deformed.

Figure 8:
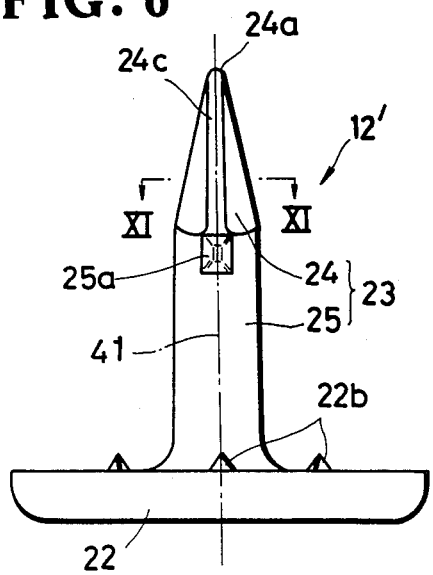
FIG. 8 is a side elevational view of a modified tack member.
Figure 9:
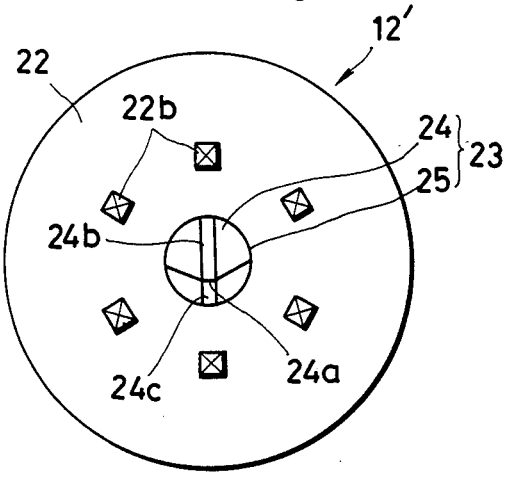
FIG. 9 is a plan view of the tack member of FIG. 8.
Figure 10:
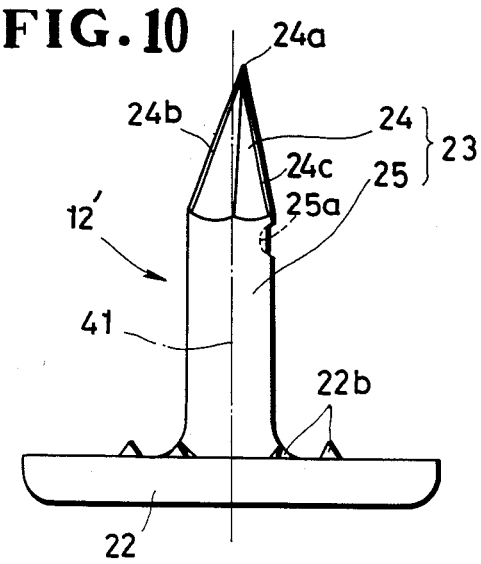
FIG. 10 is a front elevational view of the tack member of FIG. 8.
Figure 11:
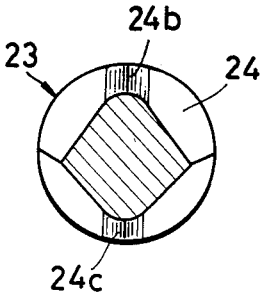
FIG. 11 is an enlarged cross-sectional view taken along line XI—XI of FIG. 8, with the tack member's head omitted.

FIGS. 8 to 11 illustrate a modified tack member 12′ in which the distal end 24*a* of the pyramid-shaped tapering end portion 24 is round as viewed in FIG. 8, i.e. from a radial direction in which the recess 25*a* is positioned. Further, one of the ridges (of the pyramid-shaped tapering end portion 24) that is disposed most remotely from the recess 25*a* has a circumferentially curved surface 24*b* along the entire length of the same ridge. Likewise, another ridge that is disposed most adjacent to the recess 25*a* also has a circumferentially curved surface 24*c*. As the tapering end portion 24 is forced against the back plate 16*a*, the rounded distal end 24*a* and, subsequently, one of the rounded ridges 24*b* slides on the back plate 16*a* smoothly, thus facilitating the bending of the tapering end portion 24.

Figure 12:
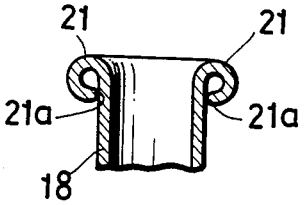
FIGS. 12 and 13 are fragmentary cross-sectional views showing modified forms of an inner tube of a button back's hollow hub.
Figure 13:
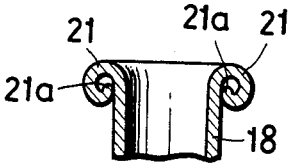

FIGS. 12 and 13 illustrate alternative forms of the inner tube 18 of the button back's hollow hub 17. In the inner tube 18 of FIG. 12, the curled annular flange 21 terminates in a radially inwardly directed edge 21*a* which is in contact with a peripheral surface of the inner tube 18. In the inner tube 18 of FIG. 13, the curled annular flange 21 terminates in an upwardly directed edge 21*a*, with a peripheral surface therealong being in contact with a peripheral surface of the inner tube 18. With such curled annular flange 21, the inner tube 18 is free from being swelled even when a relatively great amount of radially outwardly pressing force is exerted on the inner tube 18 during insertion of the tack member's shank 23 through the inner tube 18.

Although various minor modifications may be suggested by those versed in the art, it should be understood that I wish to embody within the scope of the patent warranted hereon, all such embodiments as reasonably and properly come within the scope of my contribution to the art.

What is claimed is:

1. A button for attachment to a garment fabric, comprising:

(a) a button body including a button back, a cap covering said button back on its obverse side, and a back plate disposed between said button back and said cap, said button back having a hollow hub disposed remotely from said cap and extending axially of said button back, said hollow hub having a pair of concentric inner and outer tubes joined at one end thereof, said inner tube having an outwardly curled annular flange projecting outwardly from the other end of said inner tube and terminating in an edge between said tubes and which defines a circle of a diameter smaller than the maximum outside diameter of said curled annular flange;

(b) a tack member including a head, and a shank projecting perpendicularly and centrally from said head for piercing through the garment fabric and then being inserted into said hollow hub of said button back to thereby join said tack member with said button body; and (c) said shank including a stem portion of circular cross section and a tapering end portion, said shank having a cold-pressed recess adjacent to a border between said stem portion and said tapering end portion, said recess of said shank being disposed in such a position that said recess is disposed adjacent to said curled annular flange of said hollow hub of said button back when said shank is fully inserted through said hollow hub with the garment fabric sandwiched between said tack member's head and said hollow hub, said tapering end portion having a distal end disposed off the axis of said shank toward said recess, said tapering end portion being bendable about said recess as said distal end is forced against said back plate during the insertion of said shank into said hollow hub of said button back.

2. A button according to claim 1, said recess having a contour of generally a frustrum of a pyramid.

3. A button according to claim 1, said shank of said tack member having a pair of lateral protuberances disposed contiguously to said recess at opposite side thereof.

4. A button according to claim 1, said tapering end portion having a pyramidal configuration defined by a plurality of sloping surfaces with ridges therebetween meeting at said distal end, said distal end of said tapering end portion being round as viewed from a radial direction in which said recess is positioned, one of said ridges that is disposed most remotely from said recess being round along the entire length of said one ridge.

5. A button according to claim 1, said edge of said curled annular flange around said edge thereof being in contact with a peripheral surface of said inner tube.

6. A button according to claim 1, a peripheral surface of said curled annular flange around said edge thereof being in contact with a peripheral surface of said inner tube.

* * * * *